US006267102B1

(12) United States Patent
Parrullo et al.

(10) Patent No.: US 6,267,102 B1
(45) Date of Patent: Jul. 31, 2001

(54) CARBURETOR WITH DISPLACED IDLE FLOW

(75) Inventors: George M Parrullo, Caro; Michael P. Burns, Fostoria, both of MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/511,589

(22) Filed: Feb. 23, 2000

(51) Int. Cl.[7] ..... F02M 7/00; F02M 3/12

(52) U.S. Cl. ..... 123/437; 123/585; 123/339.23; 261/DIG. 67

(58) Field of Search ..... 123/437, 439, 123/339.23, 26, 585; 261/DIG. 67

(56) References Cited

U.S. PATENT DOCUMENTS

| | | | | |
|---|---|---|---|---|
| 4,063,541 | * | 12/1977 | Landers | 261/DIG. 69 |
| 4,427,608 | * | 1/1984 | Ross | 261/39.5 |
| 4,534,333 | * | 8/1985 | Slattery | 123/557 |
| 4,715,351 | * | 12/1987 | Pankow | 123/587 |
| 4,852,539 | * | 8/1989 | Pankow | 123/585 |
| 4,890,586 | * | 1/1990 | Fujii et al. | 123/184.55 |
| 5,250,233 | | 10/1993 | Swanson . | |
| 5,611,312 | | 3/1997 | Swanson et al. . | |
| 5,623,904 | * | 4/1997 | Matsumoto | 123/339.23 |
| 6,186,117 | * | 2/2001 | Matte | 123/437 |

* cited by examiner

*Primary Examiner*—Henry C. Yuen
*Assistant Examiner*—Hieu T. Vo
(74) *Attorney, Agent, or Firm*—Reising, Ethington, Barnes, Kisselle, Learman & McCulloch, P.C.

(57) ABSTRACT

A single needle diaphragm type carburetor has a throttle valve in a mixing passage with a venturi, an idle fuel nozzle downstream of the throttle valve when in its idle position, a high speed fuel nozzle preferably disposed within the venturi upstream of the throttle valve and a supplemental air bleed passage opening into the mixing passage upstream of both the idle and high speed fuel nozzles. Both the idle and high speed fuel nozzles communicate with each other through a transfer passage and are fed from the same fuel circuit controlled by a single needle valve which limits the fuel flow to them. At idle or low speed and low load engine operation air supplied by the supplemental air bleed passage is mixed with fuel supplied to the idle fuel nozzle. At wide open throttle, air from the air bleed passage is routed near the idle fuel nozzle, and mixed with the fuel supplied to the high speed nozzle. The air routed adjacent to the idle nozzle dries out, reduces or eliminates the liquid fuel adjacent thereto such that upon come down of the engine from wide open throttle to idle, there is not an excessive amount of fuel available to the idle nozzle which would cause an over rich come down. Advantageously, the carburetor is readily adjustable with the single needle valve and provides improved performance of the engine throughout its operational range.

16 Claims, 1 Drawing Sheet

CARBURETOR WITH DISPLACED IDLE FLOW

FIELD OF THE INVENTION

This invention relates generally to internal combustion engines and more particularly to a carburetor providing a fuel and air mixture for internal combustion engines.

BACKGROUND OF THE INVENTION

Carburetors are currently used to provide the combustion fuel requirements for a wide range of two cycle and four cycle engines including handheld engines, such as engines for chainsaws and weed trimmers, as well as a wide range of marine engine applications. Diaphragm type carburetors are particularly useful for handheld engine applications wherein the engine may be operated in substantially any orientation, including upside down. Typically diaphragm carburetors have been used with two cycle engines and there is a continuing struggle to reduce the exhaust emissions of these engines to prevent escape to the atmosphere of hazardous hydrocarbon vapors and to comply with increasingly strict governmental regulations regarding the same. Still further, engine manufacturers are continually seeking carburetors which are easier to calibrate and of lower cost.

A conventional diaphragm type carburetor has a high speed fuel circuit and an idle or low speed circuit. Typically, the high speed fuel circuit fuel jet or nozzle is disposed upstream of a throttle valve in a venturi of the carburetor body and the idle circuit has a plurality of fuel jets or nozzles some of which are disposed downstream of the throttle valve within the throttle bore. Each fuel circuit has a separate fuel adjustment needle which cooperates with a valve seat to limit the fuel flow available to the nozzles of its corresponding fuel circuit to control the amount of liquid fuel delivered from the carburetor. When the throttle valve is closed, or nearly so, such as at idle or low speed and low load engine operation, substantially no fuel is provided through the high speed fuel circuit and most, if not all of the engine fuel requirements are supplied through the idle or low speed circuit. When the throttle is wide open, fuel is fed to the engine primarily from the high speed fuel circuit of the carburetor, usually with some fuel supplied from the idle fuel circuit, although, in some systems the idle circuit may be shut off by a valve actuated by the throttle shaft.

To provide a lower cost carburetor, one solution has been to provide a single needle diaphragm carburetor which provides fuel entirely through a single fuel circuit of the carburetor. All of the fuel passes through a single needle valve orifice and out of the same series of holes or nozzles at idle or low speed and low load conditions as well as wide open throttle conditions. Holes of the series are provided both downstream and upstream of the throttle valve of the carburetor in a similar location as that of the idle fuel circuits of a carburetor having both idle and high speed fuel circuits each with a separate adjustment needle valve.

While the single needle diaphragm carburetor is of lower cost, it has poor acceleration characteristics, and an extremely rich idle calibration to partially compensate for the poor acceleration characteristics inherent to this type of system. This rich idle calibration condition can cause poor idle stability and contributes to poor stability of the engine as the engine comes down from high load conditions such as wide open throttle to a low load condition such as idle. The poor come down stability is due to the fact that at wide open throttle a greater quantity of fuel is passing through the fuel nozzles and the fuel circuit than is needed for idle engine operation such that when the throttle valve is subsequently moved from wide open throttle to its idle position an excessive amount of fuel is left in the nozzles and the fuel circuit providing a fuel and air mixture to be delivered to the engine which is excessively rich for engine come down and idle operation. This rich fuel and air mixture reduces engine stability and can even cause the engine to cease to operate.

Despite these significant shortcomings, single needle diaphragm carburetors have been successfully employed in use with piston port and relatively large displacement two-stroke engines. However, many small engine applications, such as for chainsaws, weed trimmers and the like, utilize very small displacement two-stroke engines and four-stroke engines due to the benefits in fuel economy and reduced engine emissions. The above noted shortcomings of the single needle diaphragm carburetor are particularly problematic with these mini four-stroke engines and small two-stroke engines.

SUMMARY OF THE INVENTION

A single needle diaphragm type carburetor has a venturi bore therethrough, a throttle valve in the venturi bore, an idle fuel nozzle downstream of the throttle valve when in its idle position, a high speed fuel nozzle preferably disposed within a venturi portion of the bore upstream of the throttle valve and a supplemental air bleed passage which is open upstream of both the idle and high speed fuel nozzles. Both the idle and high speed fuel nozzles communicate with each other and are fed from the same fuel circuit controlled by a single needle valve which limits the fuel flow to them. The supplemental air bleed passage provides air at idle or low speed and low load engine operation which communicates with the fuel which flows through the needle valve to facilitate delivery of a fuel and air mixture (emulsified fuel) to the idle fuel nozzle. At wide open throttle, this supplemental air flow is routed near the idle fuel nozzle and passes through high speed nozzle along with the fuel that flows therethrough without any significant amount of fuel or air flowing out of the idle fuel nozzle. The supplemental air routed adjacent to the idle nozzle dries out, reduces or eliminates the liquid fuel adjacent thereto such that upon come down of the engine from wide open throttle to idle, there is not an excessive amount of fuel supplied to the idle circuit which avoids an overly rich fuel condition during engine come down. Therefore, the stability of the engine throughout its operating range is dramatically improved. Desirably, this single needle diaphragm type carburetor may be used with a wide variety of engine designs including mini four-stroke engines, two-stroke crank case reed valve engines and two-stroke piston port induction engines.

The high speed fuel nozzle is preferably located closely adjacent to the path of fuel flow at idle such that fuel is readily available to the high speed fuel nozzle when the throttle valve is rapidly opened to improve acceleration performance and stability. Also, when the throttle valve is rapidly opened from its idle position, fuel and air is preferably momentarily drawn out of both the idle fuel nozzle and high speed fuel nozzle to provide a temporary rich fuel and air mixture which also improves the acceleration performance and stability of the engine. Also, desirably, the high speed fuel nozzle is disposed within the venturi portion of the fuel and air mixture bore to take advantage of the high pressure drop therein to facilitate drawing fuel into the fuel and air mixture bore at high speed or high load engine conditions to improve acceleration as well as wide open throttle engine stability and performance.

Objects, features and advantages of this invention include providing a single needle diaphragm carburetor which is extremely easy to calibrate, is easy to adjust after initial calibration, provides improved acceleration, provides excellent performance without an over rich idle calibration, improves engine stability throughout the engine operating range, selectively provides fuel from both the idle fuel nozzle and high speed fuel nozzle without mechanical shut off devices or check valves, provides greatly improved come down stability, provides a fuel nozzle in the venturi portion of the carburetor to take advantage of the greater pressure drop therein, permits the engine to be used in substantially any orientation, permits use of a larger venturi, can provide increased engine horsepower, provides a reduced engine exhaust emissions, provides supplemental air to the idle fuel nozzle to improve idle stability even if the carburetor is calibrated rich for idle engine operation, is of relative simple design and economical manufacture and assembly, reliable and has a long, useful life in service.

BRIEF DESCRIPTION OF THE DRAWINGS

These and other objects, features and advantages of this invention will be apparent from the following detailed description of the preferred embodiment and best mode, appended claims and accompanying drawings in which:

DETAILED DESCRIPTION OF THE PREFERRED EMBODIMENT

Figure 1:
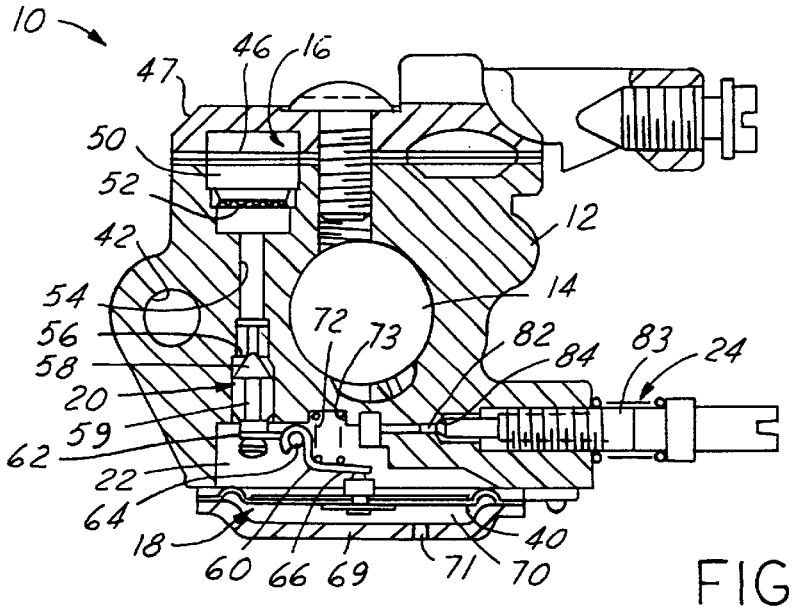
FIG. 1 is a cross-sectional view of a carburetor embodying the present invention.
Figure 2:
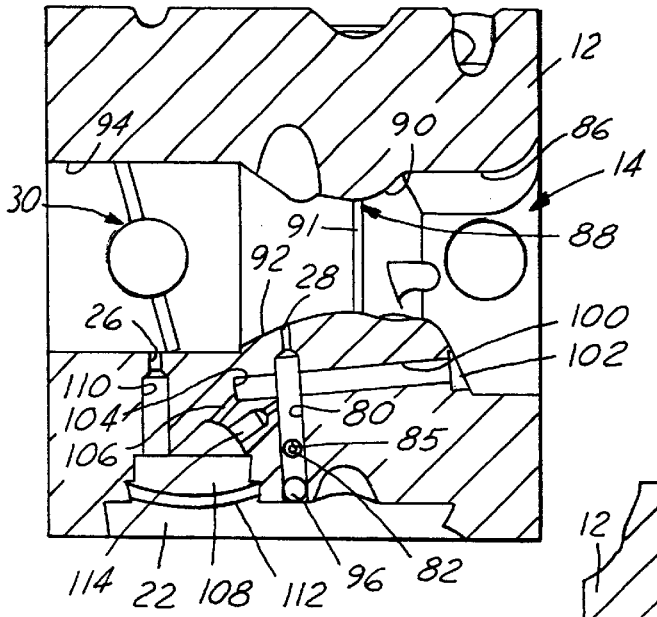
FIG. 2 is a cross-sectional view of a body of the carburetor of FIG. 1 illustrating the throttle valve in its idle position.
Figure 3:
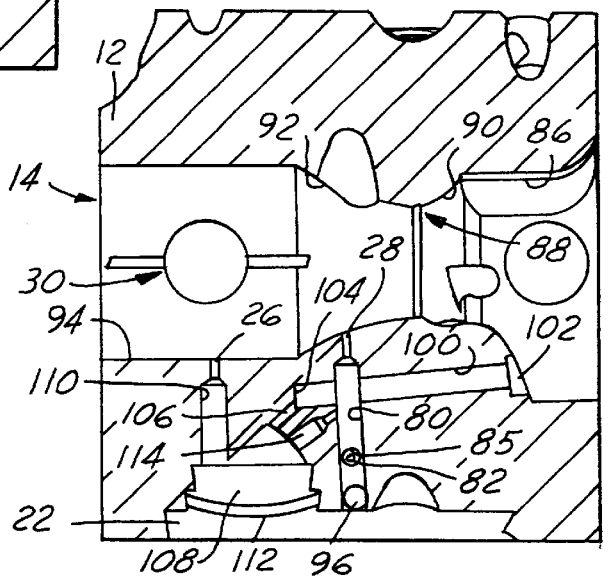
FIG. 3 is a cross-sectional view of the carburetor body of FIG. 1 illustrating the throttle valve in its wide open throttle position.

Referring in more detail to the drawings, FIGS. 1–3 illustrate a single needle diaphragm type carburetor 10 embodying the present invention and having a main body 12 with a fuel and air mixing passage 14 therethrough, a fuel pump 16, and a fuel metering assembly 18 communicating with the outlet of the fuel pump 16 through a diaphragm controlled valve 20. The fuel pump 16 draws fuel from a fuel source such as a fuel tank and delivers it to a fuel metering chamber 22 which communicates with the fuel and air mixing passage 14 through a needle valve 24 and an idle fuel nozzle 26 (FIGS. 2 and 3) and a high speed fuel nozzle 28 (FIGS. 2 and 3) downstream of the needle valve 24. A throttle valve 30 in the fuel and air mixing passage 14 controls the flow of air therethrough and also the magnitude of the pressure drop across the idle fuel nozzle 26 and the high speed fuel nozzle 28 to control the flow of fuel through the nozzles 26, 28 and the delivery of a fuel and air mixture to the engine.

The fuel pump 16 in the body receives fuel from a fuel inlet (not shown) and delivers it to the metering chamber 22 through the diaphragm controlled inlet valve 20 in a conventional circuit including the fuel pump 16, the inlet valve 20, and a fuel metering diaphragm 40. The carburetor is attached to the engine through mounting holes 42. Small passages (not shown) opening into the mounting face of the carburetor receive engine crankcase pressure pulses for actuating a diaphragm 46 of the fuel pump 16 received on the top of the carburetor body 12 under a top plate or housing cap 47.

In use, the pump 16 delivers fuel to the inlet valve 20 through a chamber 50 with a filter screen 52 therein and a passage 54 having a valve seat 56. The inlet valve 20 has a needle shaped head 58 and a shaft 59 which is actuated by a lever arm 60 connected at one end 62 to the valve, fulcrumed between its ends on a pin 64 and having a control finger 66 actuated at its free end by the fuel metering diaphragm 40. The fuel metering diaphragm 40, in cooperation with the body 12, defines the fuel metering chamber 22 and in cooperation with a cover plate 69 defines a dry or air chamber 70 communicating with the atmosphere through an opening 71. The inlet valve 20 is yieldably urged to its closed position bearing on the seat 56 by a coil spring 72 and is actuated to an open position by movement of the diaphragm 40. The coil spring is received in a pocket 73 in the body and bears on the finger 66 of the lever arm 60.

In use, as fuel is drawn from the metering chamber 22, the quantity of fuel therein will decrease and the differential pressure on the metering diaphragm 40 will move the lever arm 60 against the bias of the spring 72 in a counterclockwise direction (as viewed in FIG. 1), to open the valve 20 and allow fuel to enter the metering chamber 22. As the metering chamber 22 fills with additional fuel, the diaphragm 40 will tend to move the lever arm 60 clockwise and close the valve 20 to thereby regulate the pressure of the fuel within the metering chamber 22.

The carburetor body 12 has a fuel and air mixing passage 14 formed therethrough with the throttle valve 30 disposed in a downstream portion of the fuel and air mixing passage 14. An upstream or choke valve bore portion 86 of the fuel and air mixing passage 14 preferably contains a choke valve (not shown) and leads to a venturi 88. The venturi 88 has a converging upstream portion 90, a throat 91 and a diverging downstream portion 92 leading to a throttle valve portion 94 of the passage 14 containing the throttle valve 30.

As best shown in FIGS. 2 and 3, fuel in the metering chamber 22 is supplied to both a high speed fuel nozzle 28 and idle or low speed fuel nozzle 26 through a fuel feed passage 80 communicating with the fuel metering chamber 22 through the needle valve assembly 24. As best shown in FIG. 2, the needle valve assembly 24 has a valve head or conical tip 82 on a shank 83 threaded into the body and axially displaceable relative to a valve seat 84 to control the size of the gap or orifice 85 between them to thereby control the flow of fuel from the fuel metering chamber 22 to the fuel feed passage 80. Notably, a single needle valve assembly 24 controls the flow of fuel to both the high speed fuel nozzle 28 and the low speed fuel nozzle 26 to facilitate calibrating and adjusting the carburetor 10.

The fuel feed passage 80 communicates with the needle valve orifice 85 and receives fuel therein from the fuel metering chamber 22 in response to a pressure differential between the fuel and air mixing passage 14 and the fuel metering chamber 22. The fuel feed passage 80 preferably communicates directly with the high speed fuel nozzle 28 disposed within the venturi portion 88 of the fuel and air mixing passage 14. To prevent direct communication between the fuel feed passage 80 and fuel metering chamber 22, a plug 96 such as a brass ball, is press-fit into the fuel feed passage 80 between the needle valve orifice 85 and fuel metering chamber 22.

A supplemental air passage 100 is open at one end 102 to the upstream portion 86 of the fuel and air mixing passage 14, and opens adjacent its other end 104 through an intermediate passage 106 to an idle fuel pocket 108. The fuel pocket 108 in turn leads to an idle fuel passage 110 and the idle fuel nozzle 26 downstream thereof which opens into the fuel and air mixing passage 14 downstream of the throttle valve 30 when it is in its closed or idle position as shown in FIG. 2. The idle fuel pocket 108 is separated from the fuel metering chamber 22 by a suitable plug 112 to prevent communication between them and communicates with the fuel feed passage 80 through a transfer passage 114 extending between them. Therefore, the idle fuel nozzle 26 is communicated with the high speed fuel nozzle 28 through the idle fuel passage 110, idle fuel pocket 108, transfer passage 114, and the fuel feed passage 80. The supplemental air passage 100 communicates with the idle fuel nozzle 26 through the passage 106, idle fuel pocket 108 and idle fuel passage 110. The supplemental air passage 100 also communicates with the high speed fuel nozzle 28 through the passage 106, idle fuel pocket 108, transfer passage 114 and the fuel feed passage 80 leading to the nozzle 28. Notably, the supplemental air passage 100 does not open directly into nor communicate directly with the fuel feed passage 80. In this regard, FIGS. 2 and 3 are somewhat simplified to illustrate the pertinent passages in a single view. The orientation and communication between the various passages, and the idle fuel pocket 108, idle fuel nozzle 26 and high speed fuel nozzle 28, provide very desirable performance characteristics in operation of the carburetor 10 and engine as described below.

As shown in FIG. 2 when the throttle valve 30 is in its idle position and the engine is operating, the flow of air through the fuel and air mixing passage 14 and around the throttle valve 30 creates a pressure drop at the idle fuel nozzle 26 which draws a fuel and air mixture (dispersed fuel) through the nozzle 26 into a passage 14. Air flows through the supplemental air passage 100, through the passage 106, into the idle fuel pocket 108 and to the idle fuel passage 110. Air may also flow through the high speed nozzle 28, from the fuel and air mixing passage 14 (due to the pressure differential across it) into the fuel feed passage 80, the transfer passage 114, the idle fuel pocket 108 and into the idle fuel passage 110.

The pressure drop across the idle fuel nozzle 26 creates a pressure differential between the fuel feed passage 80 and the metering chamber 22 to draw fuel through the needle valve orifice 85 and into the fuel feed passage 80. From the fuel feed passage 80 the liquid fuel flows through the transfer passage 114, into the idle fuel pocket 108, the idle fuel passage 110 and to the idle fuel nozzle 26 for delivery into the fuel and air mixing passage 14 downstream of the throttle valve 30. Notably, the air which flows through the high speed nozzle 28 and the supplemental air passage 100 is mixed with the liquid fuel in the idle pocket 108 prior to its being discharged into the mixing passage 14 whereupon it is mixed with additional air flowing around the throttle valve 30 in the mixing passage 14. This fuel and air mixture is delivered to the engine to supply the engine's idle fuel demand. Notably, fuel is only provided through the idle fuel nozzle and is not provided through the high speed fuel nozzle upstream thereof. Additionally, the air added to the liquid fuel prior to its discharge from the idle fuel nozzle 26 helps to make the fuel and air mixture leaner to prevent an over rich fuel mixture from being delivered to the engine.

As shown in FIG. 3, with the engine operating, when the throttle valve 30 is in its wide open position a significant pressure drop exists across the high speed fuel nozzle 28 and a significantly lesser pressure drop across the idle fuel nozzle 26. At stable wide open throttle operation, the fuel to be delivered from the carburetor 10 is preferably drawn into the fuel and air mixing passage 14 through only the high speed fuel nozzle 28. Air which enters the supplemental air passage 100 flows through the passage 106 into the idle fuel pocket 108 and is drawn back through the transfer passage 114 to the fuel feed passage 80 to be dispersed with the liquid fuel therein. The pressure drop across the high speed fuel nozzle 28 draws fuel from the metering chamber 22 through the needle valve orifice 85 to the high speed nozzle 28 for delivery to the fuel and air mixing passage 14. Desirably, the high-speed fuel nozzle 28 is positioned closely adjacent to and preferably immediately downstream of the needle valve orifice 85 so that fuel is readily available to the high speed fuel nozzle 28 to meet the rapidly increasing fuel demand of the engine during acceleration.

Desirably, when the throttle valve 30 is initially opened or moved from idle to its wide open throttle position, fuel may be temporarily discharged through both the idle fuel nozzle 26, via fuel already in pocket 108 and/or passage 110 prior to throttle valve movement to wide open throttle, and high speed fuel nozzle 28. This provides a rich fuel air mixture to the engine to ensure sufficient fuel to accelerate the engine. This delivery of fuel through both fuel nozzles 26, 28 is momentary and generally desirable only for acceleration of the engine. Thereafter, the high speed fuel nozzle 28 delivers sufficient fuel to satisfy the engine's fuel demand at wide open throttle or high speed, high load engine operating conditions.

Notably, after at least some time at wide open throttle, there is preferably no fuel or air delivered through the idle fuel nozzle 26 and any liquid fuel remaining in the idle fuel pocket 108 is either drawn into the transfer passage 114 or is dried out by the air flow from the supplemental air passage 100 into the idle pocket 108, and the transfer passage 114. In this manner, most, if not all of the fuel is removed from the idle fuel pocket 108 at wide open throttle operation. Desirably, this prevents a pool of liquid fuel from being readily available to the idle fuel nozzle 26 which would cause an overly rich fuel and air mixture to be delivered from the carburetor 10 when the throttle valve 30 is rapidly returned to its idle position.

The delivery of an overly rich fuel and air mixture during the come down of the engine from a high speed or high load condition to a low speed or low load condition is undesirable as it leads to engine instability and may even cause the engine to cease to operate. Desirably, by removing the liquid fuel from the idle fuel pocket 108, this overly rich come down condition is avoided because as the throttle valve 30 is moved from its wide open throttle position to its idle position, liquid fuel is not immediately available to the idle fuel nozzle 26, but rather must flow from the fuel feed passage 80, through the transfer passage 114, to the idle fuel pocket 108 and idle fuel passage 110 before entering the idle fuel nozzle 26. The fuel and air mixture within the mixing passage 14 which was discharged from the high speed fuel nozzle 28 before the throttle valve 30 is fully moved to its idle position, is sufficient to supply the engine's fuel demand during the come down condition. After the come down condition, when the engine is at idle or low engine speed and low load, the carburetor functions as shown in FIG. 2 to provide fuel and air through the idle fuel nozzle 26 downstream of the throttle valve 30.

By controlling the flow of fuel and air through the carburetor 10 as described, a single needle valve 24 can be used to provide calibrated fuel flow for both an idle fuel circuit and a high speed fuel circuit of the carburetor. Desirably, the idle fuel nozzle 26 may be disposed downstream of the throttle valve 30 when it is in its idle or closed position and the high speed fuel nozzle 28 may be disposed upstream of the throttle valve 30 and in a venturi 88 of the fuel and air mixing passage 14 as opposed to all of the fuel discharge holes being disposed adjacent to the throttle valve 30 as in prior single needle valve, diaphragm type carburetors. Further, the flow through the fuel nozzles 26, 28 is selectively controlled by controlling the air flow through the carburetor 10 without any expensive mechanical shut-off devices or valves. Desirably, at least the high speed fuel circuit can be readily calibrated with a single needle valve 24 and can be readily adjusted after initial calibration as desired.

The idle fuel nozzle 26 and high speed fuel nozzle 28 may each be comprised of a separate single opening into the fuel and air mixing passage 14 obviating the need for multiple idle or multiple high speed fuel nozzles, to facilitate manufacture of the carburetor 10, if desired. Disposing the idle fuel nozzle completely downstream of the closed throttle also simplifies and reduces the cost of manufacture of the carburetor. Still further, the premixing of the air from the supplemental air passage 100 with liquid fuel prior to discharge through the idle fuel nozzle 26 improves mixing of the fuel and air in the mixing passage 14 to improve engine stability at idle. Still further, the improved performance characteristics of the carburetor 10 throughout the engine's range of operation permit use of a larger venturi and fuel and air mixing passage 14 than would normally be possible on small displacement engines. This increases the maximum horsepower of the engine and improves the horsepower to emissions ratio of the engine. Still further, because an excessively rich idle fuel supply is not needed to compensate for poor acceleration performance as in prior single needle diaphragm type carburetors, emissions from the engine are drastically reduced and the fuel economy of the engine is improved. Notably, the excessively rich come down experienced with prior single needle carburetors has been eliminated to expand the number of engine designs with which this single needle carburetor can be used to include, among other engine designs, mini or very small displacement four-stroke and two-stroke engines.

What is claimed is:

1. A carburetor, comprising:

a body;

a fuel and air mixing passage formed in the body and having a venturi portion;

a throttle valve in the fuel and air mixing passage movable between idle and wide open throttle positions;

at least one high speed fuel nozzle in the body opening into the mixing passage upstream of the throttle valve when in its idle position and in communication with the fuel and air mixing passage and the fuel chamber;

at least one low speed fuel nozzle in the body opening into the mixing passage downstream of the throttle valve when in its idle position and in communication with the fuel and air mixing passage and the fuel chamber;

a supplemental air passage open to the fuel air mixing passage at one end and communicated with both the low speed and high speed fuel nozzles through one or more passages, first with a passage generally adjacent to the low speed fuel nozzle and thereafter with a passage leading to the high speed nozzle whereby at least when the throttle valve is in its wide open throttle position air flowing through the supplemental air passage passes through said passage adjacent to the low speed fuel nozzle before being drawn through the high speed nozzle to reduce the liquid fuel adjacent to the low speed fuel nozzle which is not needed for engine operation at least when the throttle valve is rapidly moved from its wide open throttle position to its idle position.

2. The carburetor of claim 1 wherein said passages adjacent to the low speed fuel nozzle comprise an idle fuel pocket and an idle fuel passage open to the idle fuel pocket and low speed fuel nozzle such that the supplemental air passage communicates with the low speed fuel nozzle through the idle fuel pocket and idle fuel passage.

3. The carburetor of claim 2 which also comprises a transfer passage open to the idle fuel pocket and a fuel feed passage open to the transfer passage and the high speed fuel nozzle such that the supplemental air passage communicates with the high speed fuel nozzle through the idle fuel pocket, the transfer passage and the fuel feed passage.

4. The carburetor of claim 3 wherein the fuel feed passage communicates with a fuel chamber of the carburetor from which fuel is provided to both the low speed and high-speed fuel nozzles.

5. The carburetor of claim 4 wherein a needle valve is adjustably carried by the body to control the flow of fuel to the fuel feed passage from the fuel chamber.

6. A carburetor, comprising:

a body having a fuel chamber;

a fuel and air mixing passage through the body;

a throttle valve in the fuel and air mixing passage movable between idle and wide open throttle positions;

at least one high speed fuel nozzle in the body opening into the mixing passage upstream of the throttle valve when in its idle position and in communication with the fuel and air mixing passage and the fuel chamber;

at least one low speed fuel nozzle in the body opening into the mixing passage downstream of the throttle valve when in its idle position and in communication with the fuel and air mixing passage and the fuel chamber;

a single adjustable valve communicating with the fuel chamber and through which all fuel supplied to both the low and high speed fuel nozzles flows;

a transfer passage communicating with both the low and high speed fuel nozzles upstream of their respective openings into the mixing passage and downstream of the adjustable valve; and a supplemental air passage in the carburetor body communicating with the fuel air mixing passage upstream of the throttle valve when in its idle position and the low speed fuel nozzle upstream of its opening into the mixing passage to control the flow of air and fuel through the low speed fuel nozzle and high speed fuel nozzle to reduce the amount of liquid fuel immediately available to the low speed fuel nozzle when the throttle valve is wide open.

7. The carburetor of claim 6 which also comprises a fuel feed passage communicating the fuel chamber with the high speed fuel nozzle and the transfer passage, an idle fuel passage arrangement communicating with the transfer passage and the low speed fuel nozzle such that the supplemental air passage communicates with the high speed fuel nozzle through the idle fuel passage, transfer passage and fuel feed passage.

8. The carburetor of claim 7 wherein the idle fuel passage arrangement has a fuel pocket portion which opens to an idle passage leading to the low speed nozzle and the transfer passage spaced from the idle passage.

9. The carburetor of claim 3 wherein at least when the throttle valve is in its fully open position the air flowing through the supplemental air passage flows to the idle fuel pocket and is drawn through the transfer passage to the fuel feed passage for delivery with liquid fuel through at least one high speed fuel nozzle and said air flow to the idle fuel pocket reduces the amount of liquid fuel therein.

10. The carburetor of claim 9 wherein at least one low speed fuel nozzle is downstream of the throttle valve at least when the throttle valve is in its idle position, and when the throttle valve is in its idle position, a pressure drop across the low speed fuel nozzle draws fuel from the fuel feed passage and air from the supplemental air passage through the low speed fuel nozzle and into the fuel and air mixture passage.

11. The carburetor of claim 2 wherein the fuel feed passage leads directly to at least one high speed fuel nozzle so fuel is rapidly available to the high speed fuel nozzle to facilitate acceleration of an engine fed by the carburetor.

12. The carburetor of claim 6 which also comprises a needle valve assembly adjustable to control the flow of fuel from the fuel chamber which supplies fuel to both the low speed and high speed fuel nozzles.

13. The carburetor of claim 6 which also comprises a venturi portion formed in the fuel and air mixture passage with each high speed fuel nozzle formed generally adjacent to the venturi portion and each low speed fuel nozzle formed downstream of the venturi portion.

14. The carburetor of claim 13 wherein the throttle valve is carried by the body in the fuel air mixture passage downstream of its venturi and at least one low speed fuel nozzle is disposed downstream of the throttle valve when it is in its idle position.

15. The carburetor of claim 13 wherein the low speed fuel nozzle comprises a single opening in the body and the high speed fuel nozzle comprises a separate single opening in the body.

16. The carburetor of claim 13 wherein at one end the supplemental air passage opens into the fuel and air mixture passage upstream of the venturi portion.

* * * * *

UNITED STATES PATENT AND TRADEMARK OFFICE

CERTIFICATE OF CORRECTION

PATENT NO. : 6,267,102 B1
DATED : July 31, 2001
INVENTOR(S) : George M. Pattullo et al.

It is certified that error appears in the above-identified patent and that said Letters Patent is hereby corrected as shown below:

Title page,
Item [76], Inventors should read -- George M. Pattullo, Caro; Michael P. Burns, Fostoria, both of MI (US) --

Column 8,
Line 61, change "claim 3" to -- claim 8 --.

Column 9,
Line 8, change "claim 2" to -- claim 7 --.

Signed and Sealed this

Thirteenth Day of August, 2002

*Attest:*

*Attesting Officer*

JAMES E. ROGAN
*Director of the United States Patent and Trademark Office*